US006167638B1

(12) United States Patent
Vavro et al.

(10) Patent No.: US 6,167,638 B1
(45) Date of Patent: Jan. 2, 2001

(54) DRYING OF GRAIN AND OTHER PARTICULATE MATERIALS

(75) Inventors: Matthew E. Vavro, Butler, PA (US); Wayne Mueller, Amdrie (CA)

(73) Assignee: Clearwater, Inc., Pittsburgh, PA (US)

( * ) Notice: Under 35 U.S.C. 154(b), the term of this patent shall be extended for 0 days.

(21) Appl. No.: 09/313,082

(22) Filed: May 17, 1999

(51) Int. Cl.[7] ..... F26B 3/00

(52) U.S. Cl. ..... 34/474; 34/475; 34/493; 34/168

(58) Field of Search ..... 34/413, 443, 467, 34/474, 475, 493, 496, 507, 60, 61, 72, 165, 168

(56) References Cited

U.S. PATENT DOCUMENTS

| | | | | |
|---|---|---|---|---|
| 1,390,341 | | 9/1921 | Cushing . | |
| 2,376,095 | | 5/1945 | Shoeld | 34/32 |
| 2,465,162 | | 3/1949 | Lockwood | 98/1.5 |
| 2,494,644 | | 1/1950 | Clement | 183/4.1 |
| 2,535,902 | | 12/1950 | Dailey, Jr. | 183/4.5 |
| 2,799,947 | * | 7/1957 | Elwess | 34/15 |
| 3,266,165 | | 8/1966 | Apostle et al. | 34/28 |
| 3,621,585 | | 11/1971 | Robertson | 34/10 |
| 4,094,075 | * | 6/1978 | Caruso | 34/72 |
| 4,189,848 | | 2/1980 | Ko et al. | 34/32 |
| 4,209,911 | * | 7/1980 | Weber | 34/9 |
| 4,257,169 | * | 3/1981 | Pierce | 34/27 |
| 4,974,337 | * | 12/1990 | Tavakoli et al. | 34/27 |
| 5,632,805 | | 5/1997 | Woodard | 96/4 |
| 5,915,816 | * | 6/1999 | Graeff | 34/378 |

* cited by examiner

*Primary Examiner*—Pamela Wilson
*Assistant Examiner*—Michelle A. Mattera
(74) *Attorney, Agent, or Firm*—William L. Krayer

(57) ABSTRACT

Very dry air is made for drying grain and other particulates. The air is dried by first cooling under pressure to remove moisture, then contacted with a drying device such as a vessel containing desiccant, then heated and released into a bed of particulates.

15 Claims, 2 Drawing Sheets

DRYING OF GRAIN AND OTHER PARTICULATE MATERIALS

TECHNICAL FIELD

This invention relates to a method of drying materials. It is particularly applicable to grain such as wheat, and other crops. It involves passing through a bed of the grain, crops or other materials a stream of very dry air which is dried preferably while cooled and under pressure so that when it is warmed again its relative humidity is very low. Preferred techniques for drying and circulating the air are disclosed.

BACKGROUND OF THE INVENTION

It is desirable to dry grain and other crops not only to reduce spoilage, but also to save on shipping charges based on weight, which otherwise would be calculated to include shipping the entire original moisture content of the grain or other agricultural product. Drying is also used to achieve a more or less standard or target moisture content, representing a regulatory or commercially desired maximum or optimum. Apart from any quality effects, it is undesirable to sell grain (and other products worth more than water) having a moisture content substantially less than such a maximum. Thus, it is common not only to reduce the moisture content of grain, but not to reduce it substantially below an acceptable maximum. This means the drying method must not only be efficient but readily controlled to achieve a target moisture content.

A rather basic method commonly used is simply to employ a large blower to force a stream of untreated atmospheric air through a silo or other container of grain. This method is subject to the vicissitudes and vagaries of weather conditions, particularly the temperature and relative humidity, and may actually add moisture to the grain rather than remove it. It is not efficient when the relative humidity is high, and generally cannot be used at night or at other times when temperatures are cool; therefore the operator may not be able to completely dry the grain in time to meet scheduled rail cars or other transportation. Also, the blowers must be quite large and will consume large quantities of power over time when relative humidity is high or when the back pressure is significant.

To increase the efficiency of atmospheric blowers, heaters for the air have been added, although simply heating does not remove moisture from the air but merely lowers the relative humidity. Some dryers using heated air also employ mechanical movers or manipulators of one type or another for the grain, so that the air need not pass through an entire bed of grain at once. If this is not done, the warm air has a tendency to deposit the moisture picked up from the lower (or upstream) part of a bed, into the upper (or downstream) part of the bed, as it is cooler than the warm air not carrying significant amounts of moisture. This means the warm air must do its job of picking up moisture more than once, an obviously inefficient result. To overcome this, the operator may increase the temperature further, which may tend to toast or at least over-dry the lower parts of the grain bed, reducing the value of the grain in more ways than one. And, the area in the presence of a flame to heat the air requires safety precautions because of the danger of explosions from grain dust. Fire hazards in such installations greatly increase insurance costs as well if insurance is available at all. Of course costs are increased by the additional equipment required for heating the air.

An early U.S. patent to Cushing, U.S. Pat. No. 1,390,341, describes an air-tight silo having radial pipes with perforations used for the distribution of compressed air; the compressed air is said to be dry, and may be heated. Typically, the silo is first decompressed to create a vacuum, and the compressed air is then released into the silo, followed by the removal of moisture. The silo remains closed, however, and the compressed air is not passed through a bed of material but simply fills the silo. No means for drying the compressed air are shown. Compressed air is also used in a drying system by Clement in U.S. Pat. No. 2,494,644.

In U.S. Pat. No. 4,189,848, inventors Ko, Grodzka, and McCormick note that the conventional heated air techniques used for drying grain waste considerable energy, as the energy used to heat the air is released to the atmosphere after the process. Their answer is to circulate the air through a desiccant to aid in removing the moisture and they provide for the conservation of heat energy partly by recirculating the desiccant, which means dehydrating it for reuse. Desiccant is circulated also by Shoeld in U.S. Pat. No. 2,376,095.

Woodard, in U.S. Pat. No. 5,632,805, describes the assisted dehydration of compressed air through the use of various dehydrating devices, including a semipermeable membrane, interposed between compression stages in the compressor. No mention is made of using the air for drying grain or other agricultural products, nor is it suggested that the delivered air be heated for that purpose.

SUMMARY OF THE INVENTION

Our process involves the compression, cooling, dehydration and warming of air prior to passing it through a bed of grain or other agricultural product to be dried; mechanical energy released on decompression is used to transport the air through the grain or other bed. The process takes advantage of the fact that the dehydration of compressed, cooled air is very efficient when conducted particularly in drying vessels designed for the purpose and with good desiccants or otherwise with known techniques. Air prepared by our process and warmed to a temperature of 80° F. to 120° F., having a relative humidity of less than two percent (2%), will quickly and reliably dry virtually any agricultural product or other bed or particulates it contacts.

DETAILED DESCRIPTION OF THE INVENTION

Figure 1:
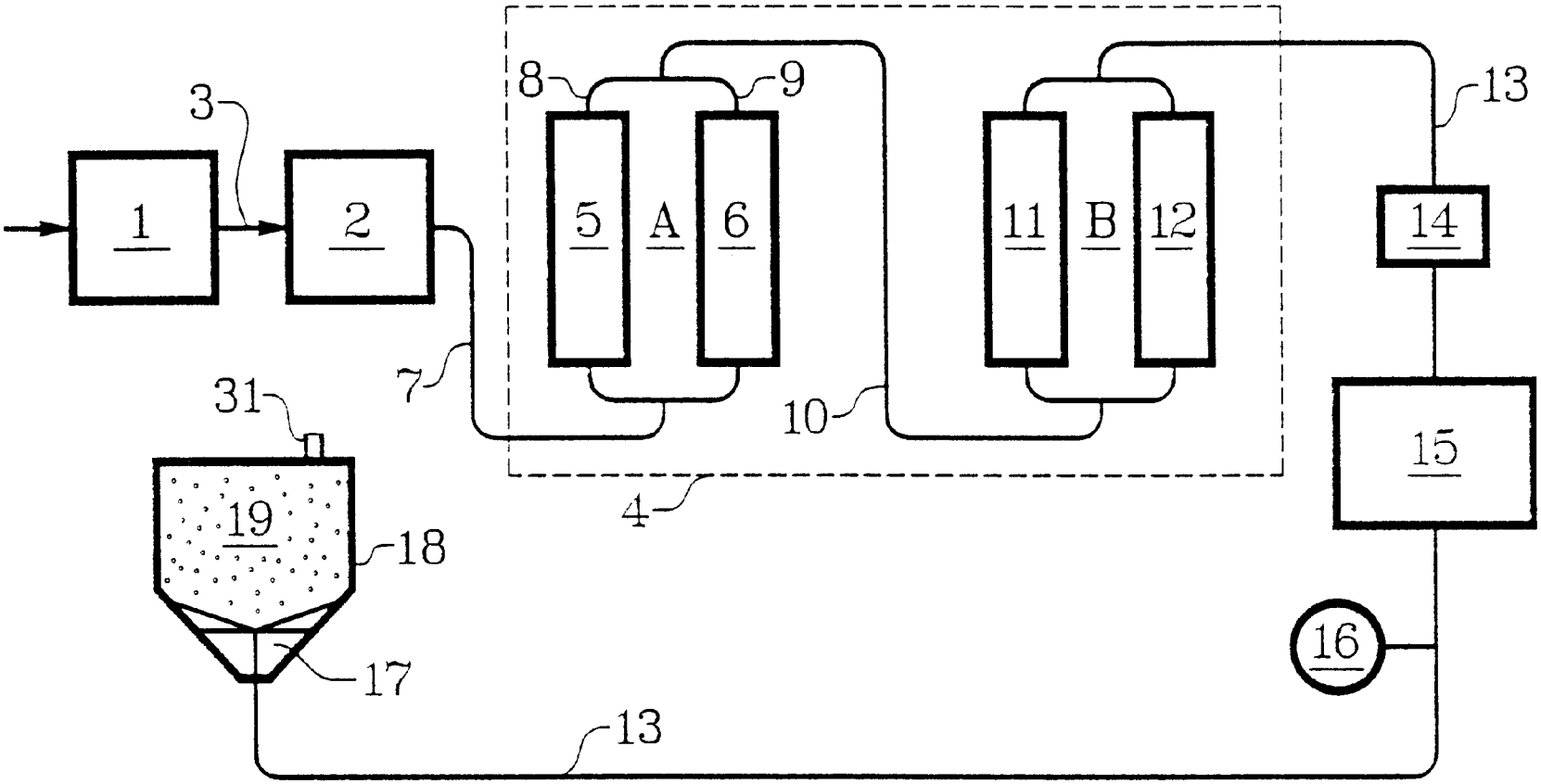
FIG. 1 is a flow sheet showing the compression, cooling, drying and warming of air followed by passing it through a bed of grain or other agricultural product as provided in our invention.

FIG. 1 is a more or less diagrammatic flow sheet showing how air is treated and used to dry a bin of grain according to our invention. About 350 to 700 standard cubic feet (scf) of ambient air is taken into compressor 1 per minute, compressed to achieve a pressure of about 100 to about 300 psia, preferably about 180 to about 220 psia. As is known, the process of compressing tends to warm the air, which is then continuously delivered to cooler 2 through line 3. Cooler 2 is capable of continuously cooling any amount of air delivered to it by compressor 1 to a temperature preferably from about 60° F. to about 80° F., or alternately preferably from about 5 to about 25 degrees F. higher than the beginning temperature (more preferably about 8–13° F. higher than starting).

From cooler 2, the still pressurized and cooled air is delivered to dryer 4 which may have two drying zones designated as zone A and zone B. In this preferred configuration, zone A comprises two parallel drying vessels 5 and 6, both of which are fed directly by line 7 coming from cooler 2. Drying vessels 5 and 6 may be of any known design and preferably contain a desiccant; they may be of the design shown in FIG. 2. The initially dried air exits from drying vessels 5 and 6 through lines 8 and 9, which are joined in line 10, in turn divided for delivery of the still pressurized and cooled air to secondary drying vessels 11 and 12. After exiting from drying vessels 11 and 12 into combined line 13, the air is still cool (about 60° F. to 80° F.) and contains typically less than ten pounds of moisture per million scf. Back pressure regulator 14 may be used on line 13 to maintain the desired pressure in the system.

The air in line 13 proceeds to heater 15, which may be a water bath heater; it should be capable of continuously increasing the temperature of the air in line 13 from 70° F. to 120° F. at the desired flow rate. A meter 16 may be installed at this point to monitor the pressure, temperature and/or flow of the air. Line 13 is connected to air spreader 17 inside bin 18. Air spreader 17 may be a radial system of perforated pipes connected to line 13 so that the now warmed air may be spread relatively evenly throughout the bin. It is still pressurized in spreader 17 but the pressure is released through the perforations in spreader 17 and the warm air is accordingly jetted into the bed 19 of grain in the bin 18. It flows upwardly through the bed 19 and out through vent 31 or other outlet means.

Figure 2:
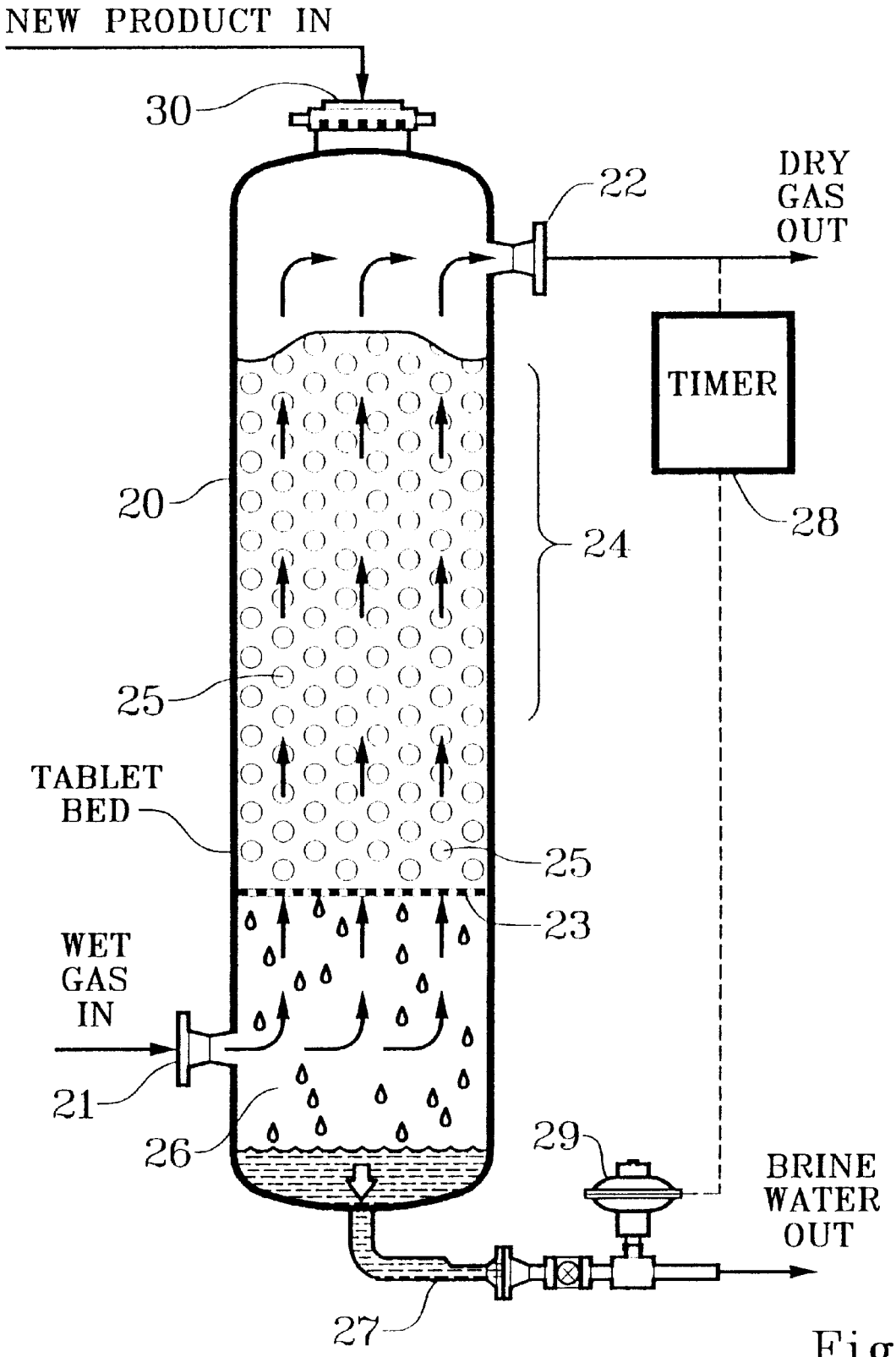
FIG. 2 is a detailed section of a prior art gas drying vessel which uses a desiccant.

The details of the preferred air drying vessel 5, 6, 11, and/or 12 are shown in FIG. 2. FIG. 2 shows drying vessel 20 having an inlet 21 for wet gas and an outlet 22 for dry gas. Perforated plate 23 holds a bed 24 of desiccant tablets 25, substantially filling the area above it. Wet gas entering inlet 21 is distributed by perforated plate 23 so that it flows substantially evenly through the bed 24, and desiccant tablets 25 are gradually dissolved as they pick up moisture from the air. The brine made by the dissolution of desiccant tablets 25 drains through perforated plate 23 into reservoir 26, which is connected to drainpipe 27. A timer 28 may open the valve 29 on the drainpipe 27 periodically or as a function of the flow of dry gas from outlet 22 as detected by a flowmeter or sensor not shown; or the drain may be operated in any other desired manner to prevent excess accumulation of brine in reservoir 26. The desiccant tablets 25 are periodically replenished by addition through opening 30. The desiccant tablets 30 may be such as those described by Thomas in U.S. Pat. No. 5,733,841 or any other suitable desiccant materials or forms. While the vessel described in connection with FIG. 2 is a preferred one, any other suitable vessel for holding desiccant and flowing air through it in contact with the desiccant may be used.

Persons skilled in the art of drying air will realize that the air from line 13 passing through spreader 17 will be quite dry. Moisture is first removed from the ambient air by the act of compressing in compressor 1. Liquid water can be drained or otherwise removed in the compressor in known ways such as drips, filters, or settling reservoirs. Cooling in cooler 2 will also remove moisture by lowering the temperature below the saturation point (dew point) in most cases; again, liquid water can be removed continuously from the cooler in a known manner by drains, drips, filters, and the like. Drying vessels 5, 6, 11, and 12 are of course designed to remove significant amounts of the remaining moisture from the air, with the assistance of desiccants or various devices known in the art for the purpose of drying. This step is made more efficient by the early removal of moisture in the compressing and cooling steps. Accordingly, when the air leaves drying zone B, it will have less than ten pounds of moisture per million cubic feet of air (scf) and, after it is heated, typically to 110° or other temperature within the range 80–120° F. and reduced to near atmospheric pressure in bin 18, its relative humidity will be, for example, 0.25%. This is an extremely efficient drying air for contact with the grain bed 19. Finally, the drying air is not simply passed through the bed 19, but is virtually propelled through it by the release of mechanical energy caused by passing through the perforations in spreader 17, due to the pressure drop as it leaves relatively high pressure line 13 and enters the far lower (near-atmospheric) pressure of vented grain bin 18.

While the above described method and apparatus are preferred, it should be noted that certain variations are within our invention. For example, cooling and drying steps can be conducted prior to compressing, depending on the specific local availabilities of the equipment. The heater can be any kind of heater, but a water bath heater is preferred because of its efficiency and convenience; nevertheless, heating of the air may be accomplished in a number of ways, such as by electrical, solar and other energy sources. Good engineering practice may suggest that the heater and cooler work in close association to conserve energy. Drying need not be done by a desiccant-equipped vessel, but also could be done by a vessel having a semipermeable membrane as in the above mentioned U.S. Pat. No. 5,632,805 and/or other membrane devices usuable for separating nitrogen from the air—the nitrogen may be dried and/or otherwise treated as the air in our process, bringing with it the advantages of reducing the possibility that the grain may be oxidized and reducing the possibility of explosion hazards from contact of the air with dry grain dust. The air spreader 17 may include nozzles and may direct the dried air downward into the silo rather than upwards while the vent 31 still provides an outlet for the upwardly flowing air; in another variation, air spreader 17 may be deployed on or near the top of bin 18 and vents or other outlets provided in the bottom of the bin 18.

We prefer the illustrated configuration for the dryer in which there are two parallel drying vessels in two stages; however, other configurations may be used for circulating the air through the drying vessels. For example, only two or more vessels of appropriate sizes may be connected in series or parallel or any combination of series or parallel.

Persons skilled in the agricultural drying art will recognize that the efficiency of our process means that the time required for drying grains and other agricultural products is significantly reduced, resulting in readily realizable economic benefits. For example, grain stations are able to move more grain through their capital equipment in a given period of time than would be otherwise possible; likewise the farmer will be able to devote his time to other matters, which can be quite critical when the weather dictates. Other economic and practical benefits derived from the relatively inexpensive and relatively safe equipment and its portability will become apparent to the user. For example, the high air temperatures mentioned above which are used to augment the function of conventional blowers are not needed with our invention, and damage to the grain is accordingly avoided.

Our invention is not limited to the drying of agricultural crops and the like, but may be used for drying any large volume of materials, such as particulate synthetic resins which have been made in an aqueous suspension, lumber, fibers, sawdust, bark, coffee and the like.

What is claimed is:

1. Method of drying particulate materials comprising (a) compressing ambient air at a beginning temperature to a pressure of about 100 to 300 psia, (b) cooling said air while under a pressure of about 100 to about 300 psia to a temperature no higher than 25 degrees F. higher than said beginning temperature to remove moisture from said air, (c) further drying said air with a drying device while under a pressure of about 100 to about 300 psia and a temperature no higher than 25° F. higher than said beginning temperature, (d) heating said air while under a pressure higher than atmospheric, and (e) releasing said air from compression into a bed of particulate materials to be dried.

2. Method of claim 1 wherein said air is dried to a moisture content no greater than 15 pounds of water per million standard cubic feet of air.

3. Method of claim 1 wherein said particulate material is an agricultural product.

4. Method of claim 1 wherein said air is released through a plurality of perforations in an air spreader into said bed at close to atmospheric pressure.

5. Method of claim 1 wherein said ambient air is cooled prior to compressing.

6. Method of claim 1 wherein said drying in step (c) is accomplished with the aid of a desiccant.

7. Method of claim 1 wherein said drying in step (c) is accomplished in a plurality of gas drying vessels wherein a desiccant is held by a perforated plate and liquid is periodically drained from said vessels.

8. Method of claim 1 wherein the drying step in step (c) is accomplished with the aid of a membrane.

9. Method of claim 1 wherein the heating of step (d) is accomplished by a thermal exchange from compressing in step (a).

10. Method of claim 1 wherein, after step (d), the air has a temperature of 80–120° F. and a relative humidity of less than 2%.

11. Method of claim 1 wherein, at the end of step (b), the temperature of the air is about 8 to about 15 degrees Fahrenheit higher than ambient.

12. Method of claim 3 wherein said agricultural product is wheat.

13. Apparatus for drying particulate materials comprising an air compressor for delivering air at a pressure of 100 to 300 psia, an air cooler for receiving pressurized air from said compressor, cooling said air to a temperature of 60° F. to 80° F. and delivering said air, means for receiving said pressurized and cooled air from said cooler and drying it, a heater for heating said air while it is still pressurized, and an air spreader for delivering heated air from said air heater into a bed of particulate materials to be dried.

14. Apparatus of claim 13 wherein said means for receiving said air from said cooler and drying it is a vessel including desiccant tablets.

15. Apparatus of claim 13 wherein said means for receiving said air from said cooler and drying it is a membrane separator.

* * * * *